United States Patent [19]

Kurokawa

[11] Patent Number: 4,509,739

[45] Date of Patent: Apr. 9, 1985

[54] APPARATUS FOR STACKING LETTER MAIL

[75] Inventor: Koji Kurokawa, Yokohama, Japan

[73] Assignee: Tokyo Shibaura Denki Kabushiki Kaisha, Japan

[21] Appl. No.: 426,134

[22] Filed: Sep. 28, 1982

[30] Foreign Application Priority Data

Oct. 26, 1981 [JP] Japan ..... 56-171007

[51] Int. Cl.[3] ..... B65H 43/00; B65H 29/44

[52] U.S. Cl. ..... 271/176; 271/179; 271/180; 271/215

[58] Field of Search ..... 271/176, 179, 180, 181, 271/177, 178, 214, 215

[56] References Cited

U.S. PATENT DOCUMENTS

| | | | |
|---|---|---|---|
| 2,856,189 | 10/1958 | Winkler | 271/214 |
| 3,051,480 | 8/1962 | Carlin | 271/215 |
| 3,814,415 | 6/1974 | Hunter | 271/176 |
| 4,270,747 | 6/1981 | Templeton | 271/179 |

*Primary Examiner*—Bruce H. Stoner, Jr.
*Assistant Examiner*—John A. Carroll
*Attorney, Agent, or Firm*—Cushman, Darby & Cushman

[57] ABSTRACT

An apparatus for stacking sheet-like articles such as envelopes side by side, i.e., horizontally, in the upright state is disclosed. An article urging lever is disposed in the neighborhood of an article supply path, along which an article to be stacked proceeds toward a stacking position, such that it is rockable between an advanced position, in which the lever is found on and blocks the article supply path, and a retreated position, in which the lever is out of the path. In the advanced position, the lever serves to prevent the stacked articles from blocking the progress of a new article along the supply path into the stacking position and also to engage the rear end portion of an article supplied into the article supply path from one side of the article and thus urges the article's rear end portion crosswise with respect to the longitudinal direction of the path, thereby permitting the next article supplied to the article supply path to freely proceed along the path. The article urged by the article urging lever is brought into engagement at its lower edge with a feed screw member and is further displaced crosswise by the action of the feed screw member. The article entering the article supply path thus can reach a forced feed mechanism, so that its forward end portion is forcibly pulled in and brought to the stacking position by the forced feed mechanism.

14 Claims, 9 Drawing Figures

APPARATUS FOR STACKING LETTER MAIL

BACKGROUND OF THE INVENTION

This invention relates to an apparatus for stacking sheet-like articles, typically postal matter such as postal cards and envelopes.

This type of stacking apparatus is used for, for instance, a postal matter processing apparatus. After the stamps and postmarks of the individual pieces of postal matter have been detected, the postal matter is sorted into ordinary postal matter and special postal matter. The sorted groups of postal matter are temporarily collected in respective stacking apparatuses. The stacked postal matter is manually taken out and sorted by the operators according to the destination.

FIG. 1 shows an example of the stacking apparatus. As shown in FIG. 1, sheet-like articles A are successively supplied by conveyor belts 10 and 11 which constitute an article supplyer into a stacking section 12. In the stacking section 12, the successively supplied articles A are stacked horizontally, i.e., side by side in the upright state, on a floor (not shown). One end of the stack is held by a back-up member 13, and the other end of the stack is held by a guide plate 14. A side wall member 15 is provided to align the forward end of each of the stacked articles. The back-up member 13 is slidably supported by a guide rod 16 and is spring biased by a spring 17 toward the stacked articles A. The guide plate 14 has a curved edge 14*a* so that the articles can be smoothly received. Each article A is guided by the curved edge 14*a* of the guide plate 14 as it is supplied from the conveyor belts 10 and 11 through an article supply path 18 to a stacking position in the stacking section 12 to be stacked in the state as shown.

The sheet-like articles A to be stacked have different lengths and are flexible so that they can be easily bent. Therefore, for the articles A to be regularly stacked to remain in the upright state in the stacking section 12, they must be held in a state slightly compressed by the back-up member 13 and guide plate 14. To this end, the spring 17 is adapted to provide a necessary compressing force. However, it sometimes happens that an article cannot be smoothly brought between the guide plate 14 and the outermost article in the stack due to the compressing force of the spring. This is particularly liable to occur when the spring force of the spring 17 is increased with the increase of the number of stacked articles. In another aspect, since the article is liable to be bent, when this occurs the rear end portion Ar of the stacked article will sometimes close the article supply path 18. In such a case, the next article A supplied is jammed, leading to the stopping of the apparatus.

SUMMARY OF THE INVENTION

An object of the invention is to provide an improved stacking apparatus, which can sufficiently supply letter mail to a predetermined stacking position in a stacking section for regularly stacking the letter mail and thus eliminates the possibility of the jamming of letter mail which are being supplied to the stacking section.

To attain this object, the stacking apparatus according to the invention includes an article urging means which is movable between an advanced position, in which the means blocks the article supply path, and a retracted position, in which the means is not in the article supply path. In its advanced position, the article urging means serves to prevent the stacked articles from blocking the entry of a new article along the supply path into the stacking section. Also in this position, the article urging means serves to engage the rear end portion of an article supplied into the article supply path from one side thereof and thus urges the article's rear end portion crosswise with respect to the longitudinal direction of the path. This has the effect of permitting the next article supplied to the article supply path to enter the stacking section without being blocked by the rear end portion of the stack of articles. The operation of the article urging means which can serve the two roles mentioned above is synchronized with the operation of an article supply mechanism which supplies articles one by one into the article supply path.

Thus, articles can be very smoothly stacked in the stacking section without the possibility of jamming.

Further, in the apparatus according to the invention, means for holding the stacked articles includes a forced feed mechanism, which enages a forward portion of the article supplied to the article supply path and forcibly brings the article to the stacking position. The stacked article holding means co-operates with a back-up member to sandwitch the stacked articles and give a slight compressing force thereto. As the reaction force, the holding means experiences a biasing force exerted in the opposite direction. This reaction force is referred to as "stacking pressure". With the conventional stacking apparatus as shown in FIG. 1, the stacking pressure increases with the increasing number of stacked articles. With the stacking apparatus according to the invention, the holding means can be moved rearwards as the stacking pressure is increased. Eventually, the holding means reaches a limit position, and this is detected by detecting means consisting of a microswitch. When the limit position is detected, the back-up member is moved in a direction to reduce the stacking pressure.

Thus, according to the invention, the stacking pressure is not excessively increased but is held in a constant and satisfactory pressure range. This permits always supplying articles into the stacking section accurately and stacking the articles in the stacking section regularly, as well as eliminating the problem of blocking an article being supplied to the stacking section.

The stacking apparatus according to the invention further includes an article attitude regulating means consisting of, for instance, a feed screw member, which is disposed crosswise with respect to the longitudinal direction of the article supply path and engageable with the lower edge portion of an article supplied into the path. This means can co-operate with the article urging means and has an effect of more positively displacing the rear end portion of article in the crosswise direction. This helps smooth entry of the next article through the article supply path into the stacking section without the possibility of jamming.

The article attitude regulating means is partially covered by a cover plate so that it will not immediately engage an article supplied to the article supply path. More particularly, the article attitude regulating means provides a correcting action on an article when the article has been slightly deviated from the supply path. If an article supplied into the article supply path is adapted to immediately engage the article attitude regulating means, which is a feed screw member, it is possible that the lower edge of the article will not smoothly engage the thread. In such a case, there is an effect of rather disturbing the attitude of the article. The article attitude regulating means provides an action only after the article has been slightly displaced crosswise by the article urging means. At this time, the lower edge of the article is experiencing a crosswise force, so that the article can be reliably engaged with the article attitude regulating means.

The above and further objects, features and advantages of the invention will become more apparent from the detailed description of the preferred embodiment when the same is read with reference to FIGS. 2 to 9 of the accompanying drawings.

DETAILED DESCRIPTION OF THE PREFERRED EMBODIMENT

The stacking apparatus according to the invention will now be described in connection with a case where postal matter such as postal cards and envelopes are dealt with as sheet-like articles with reference to FIGS. 2 to 9. For the sake of simplicity, the sheet-like articles are also referred to merely as articles.

Figure 2:
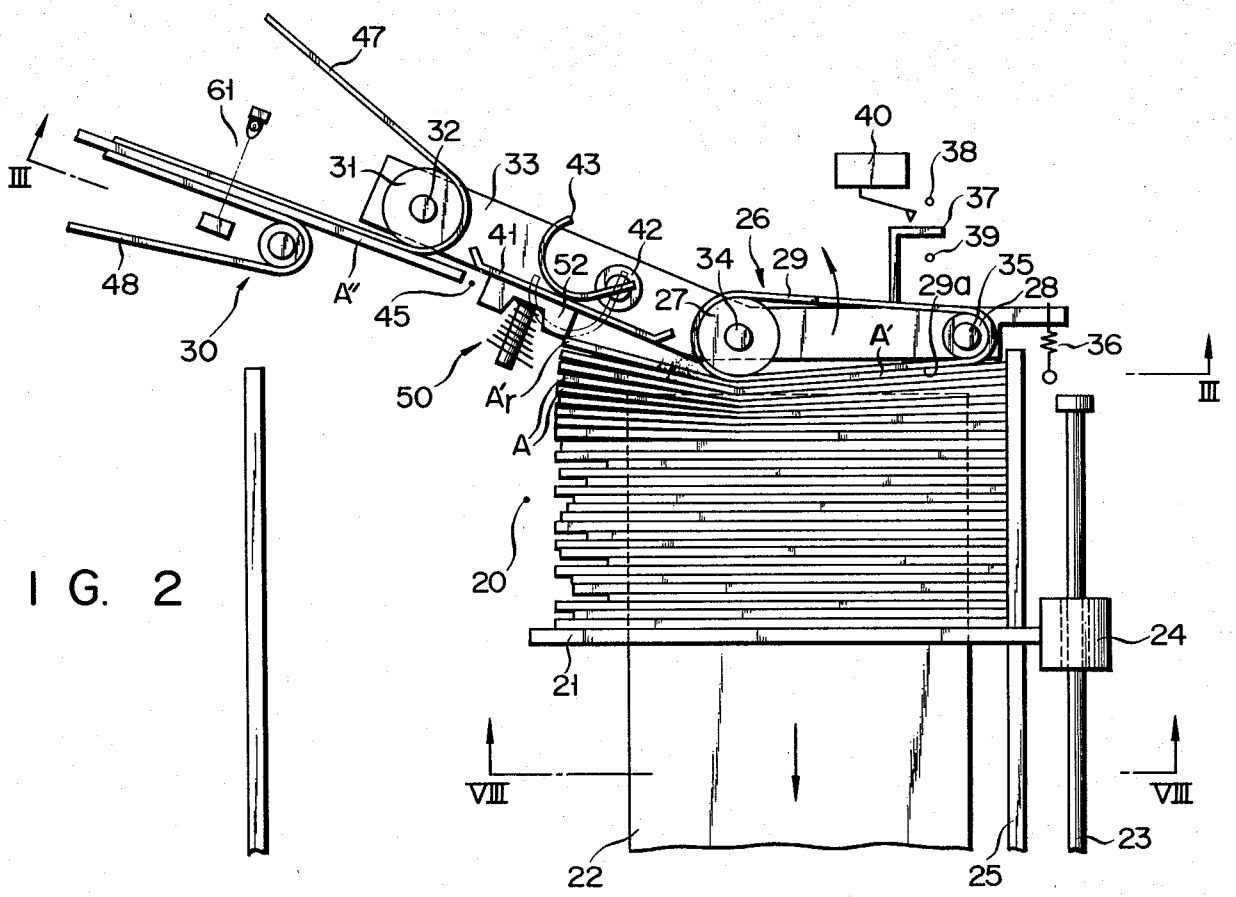
FIG. 2 is a top view showing an embodiment of the stacking apparatus according to the invention.

In FIG. 2, a number of articles A are shown already stacked in a stacking section 20. A plate-like back-up member 21 extends upright from and in frictional engagement with a horizontal wide belt member 22 which constitutes an article supporting means. An edge of the member 21 is connected to a support member 24 which is slidably coupled to a guide rod 23. One of a pair of side wall members 25 extending parallel to the guide rod 23 and is found on one side of the belt member 22 serves as an article regulating member to align the forward end of articles A stacked side by side. A forced feed mechanism 26 constitutes article holding means which cooperates with the back-up member 21 to hold the horizontally stacked articles A in a sandwiched state. The mechanism 26 includes a pair of rollers 27 and 28 and an endless belt 29 passed around these rollers. The surface of the endless belt 29 that is in contact with the outermost article A′ in the stack of articles A serves an an effective urging surface 29*a* for urging the stacked articles. The length of the effective urging surface 29*a* must be smaller than the length of the shortest article to be stacked. This is so because the rear end portion of the outermost article in the stacked state must extend from the effective urging surface 29*a* so that an inlet for receiving the next article may be defined between the rear end portion Ar of the outermost article A′ and the corresponding end portion of the effective urging surface 29*a*.

One of the rollers in the forced feed mechanism, namely roller 27, serves as a driving roller and has a greater diameter than the other roller which is a driven roller. The effective urging surface 29*a* is inclined with respect to the stacking direction, i.e., the longitudinal direction in FIG. 2. The rollers 27 and 28 are carried in a spaced-apart relation and via respective shafts 34 and 35 by a free end portion of a support lever 33, which is rockably mounted at one end on a shaft 32 of a drive roller 31 of a belt-roller conveyor mechanism 30 constituting article supply means. A spring 36 is anchored to the free end of the support lever 33. The support lever 33 is thus biased in the crosswise direction in FIG. 2, i.e., in a direction of urging the endless belt 29 against the stacked articles A.

A L-shaped arm 37 extends from the support lever 33, and it permits rocking movement of the lever 37 in a range defined by stoppers 38 and 39. That is, the endless belt 29 can be moved in the rocking directions over this range.

A microswitch 40 constituting detecting means is provided to co-operate with the arm 37. It is mounted in a suitable frame of a device (not shown). The operation of the detecting means will be described later in detail.

The support lever 33 has a bent shape consisting of two portion defining an obtuse angle. Its stem portion carries a vertically extending guide plate 41 and also carries a rotary solenoid 42 which is mounted on the back side of the guide plate 41. The rotary solenoid 42 includes an urging lever 43 having an arcuate portion constituting article urging means. The urging lever 43 can be horizontally rocked by the rotary solenoid 42 between an advanced position, in which the lever is found on and blocks an article supply path 45 as shown by imaginary lines in FIG. 2, and a retracted position, in which the lever is out of the supply path as shown by the solid lines. The guide plate 41 is formed with an opening 46, as shown in FIG. 3, and the urging lever 43 can be brought to the advanced position through this opening 46.

The article supply path 45 is one through which an article A″ having been supplied from pair belts 47 and 48 in the article supply means passes until it enters the gap defined between the endless belt 29 of the forced feed mechanism 26 and the outermost article A′ in the stack of articles. The path 45 is inclined to form an acute angle with respect to the effective urging surface 29*a* of the endless belt 29. The guide plate 41 defines part of one side of the article supply path 45.

Figure 1:
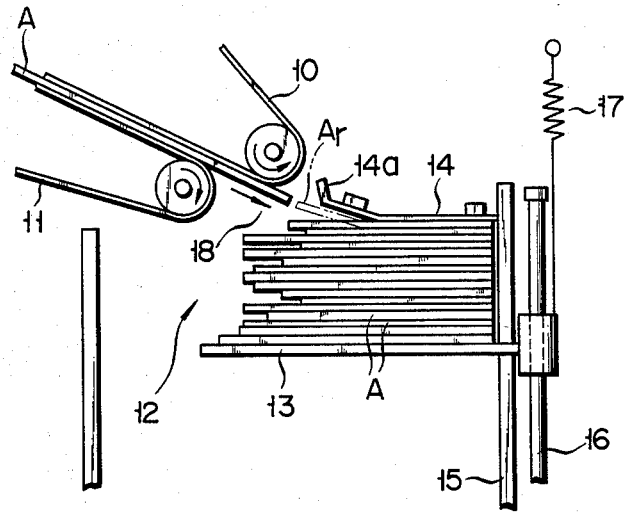
FIG. 1 (PRIOR ART)
FIG. 1 is a top view showing a prior art stacking apparatus.
Figure 3:
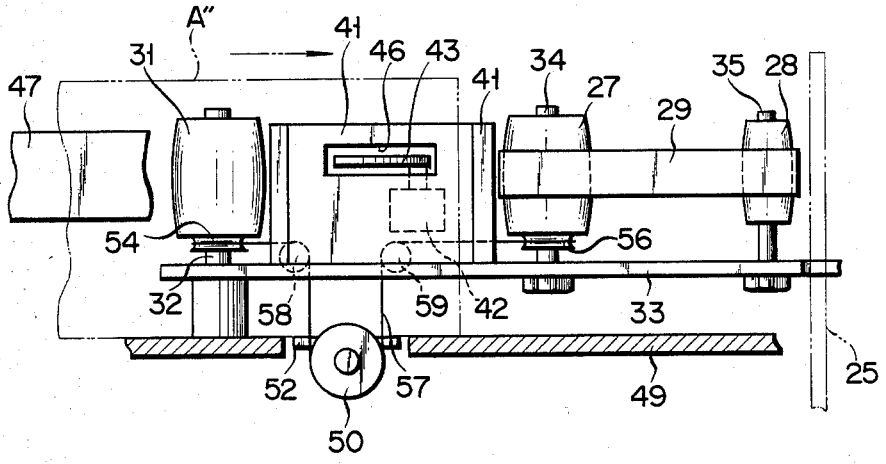
FIG. 3 is a fragmentary vertical view taken along line III—III in FIG. 2.

As shown in FIG. 3, the support lever 33 is pivotally mounted on a floor plate 49 via the shaft 32 of the drive roller 31, and it is spaced apart from and extends parallel to the support lever 33. The bottom of the path 45 is defined by the top of the floor plate 49. The floor plate 49 is not shown in FIG. 2.

A feed screw member 50 which constitutes an article attitude regulating means is supported in the support lever 33. The member 50 extends crosswise with respect to the longitudinal direction of the article supply path 45, i.e., the direction shown by arrow 51 in FIG. 7. The screw feed member 50 is rotatably mounted in the lever with a suitable frame structure which is not shown. The thread diameter of the feed screw member 50 increases as one goes crosswise away from the article supply path 45. The feed screw member 50 has its portion extending in the article supply path 45 covered from above by a substantially channel-shaped cover plate 52. As is shown in FIG. 3, the top of the cover plate 52 is flush with the top of the floor plate 49, that is, it defines part of the bottom of the article supply path 45. With this arrangement, the action of the feed screw member 50 is not provided on an article so long as the article is confined in the article supply path 45.

Figure 7:
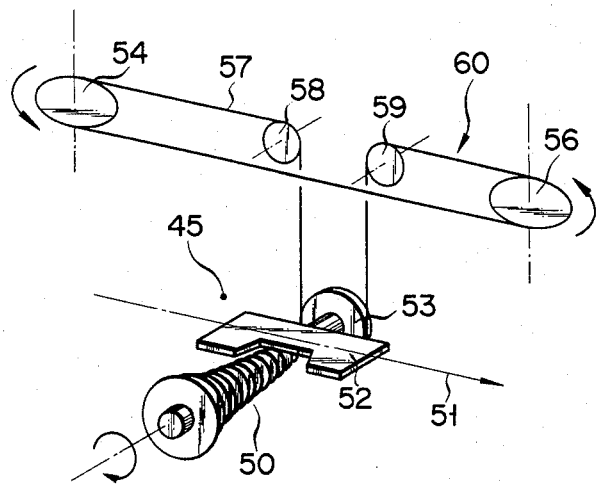
FIG. 7 is a schematic perspective view showing a drive system in the apparatus of FIG. 2.

The feed screw member 50 carries a pulley 53 provided at one end, as shown in FIG. 7. As shown in FIG. 3, the drive roller 31 of the belt-roller conveyor mechanism 30 and the drive roller 27 of the forced feed mechanism 26 are provided with respective pulleys 54 and 56. As shown in FIG. 7, an endless motion transmission string 57 is passed around the pulleys 53, 54 and 56. The pulleys 54 and 56 rotate in a horizontal plane while the pulley 53 rotates in a vertical plane. For this reason, the string 57 is also passed around a pair of intermediate pulleys 58 and 59 for conversion of the direction of motion. The pulleys 53, 54 and 56 and string 57 constitute a pulley-string transmission mechanism 60. The drive rollers 31 and 27 and feed screw member 50 are simultaneously rotated in the direction of arrows in FIG. 7 by the transmission mechanism 60. Drive force is supplied to this drive system through the belt 47 of the belt-roller conveyor mechanism 30. This mechanism permits use of only a single drive source and also permits synchronization of rotation of the rollers and feed screw member.

Of course it is possible in design to use separate drive sources in lieu of providing the transmission mechanism 60. The relation of the mechanism 60 to the support lever 33 is not shown in detail, but this coupling may be suitably designed.

In the conveyor mechanism 30 an electric sensor 61 for detecting the passage of an article is provided. A signal produced from the sensor 61 is supplied as a timing signal to the rotary solenoid 42.

Figure 8:
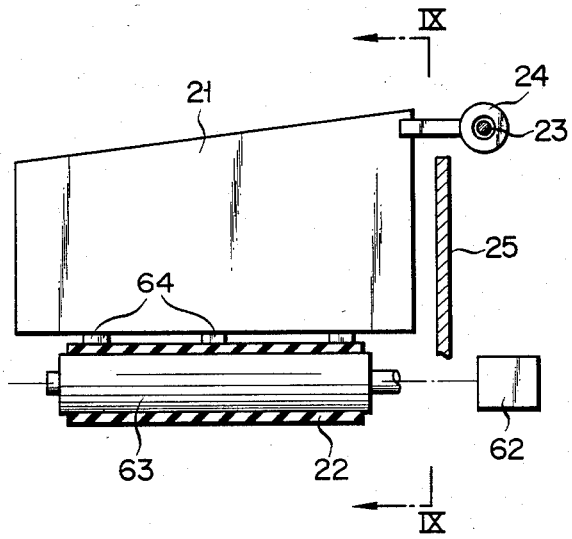
FIG. 8 is a vertical sectional view on a slightly reduced scale taken along line VIII—VIII in FIG. 2.
Figure 9:
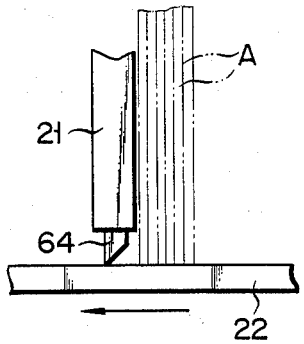
FIG. 9 is a fragmentary enlarged-scale side view taken along line IX—IX in FIG. 8.

As is shown in FIGS. 8 and 9, the wide belt member 22 is passed round a drive roller 63 which is coupled to a motor 62. The motor 62 is electrically connected to the microswitch 40 constituting the detecting means. When the microswitch 40 is turned on, the motor 62 is started and moves the belt member 22 in the direction of the arrow in FIG. 2. When the microswitch 40 is turned off, the motor 62 is stopped. The back-up member 21 which extends upright from the belt member 22, has a plurality of projections 64 projecting from its lower edge. As shown in FIG. 9, each projection 64 has a tapered end, which slightly wedges into the elastic belt member 22. This simple structure of projections 64 makes it difficult for the back-up member 21 to move over the belt member in the direction away from the stacked articles, i.e., in the direction of reducing the holding force on the stacked articles.

The operation of the stacking apparatus having the above construction according to the invention will now be described with reference particularly to FIGS. 4 to 6.

Figure 4:
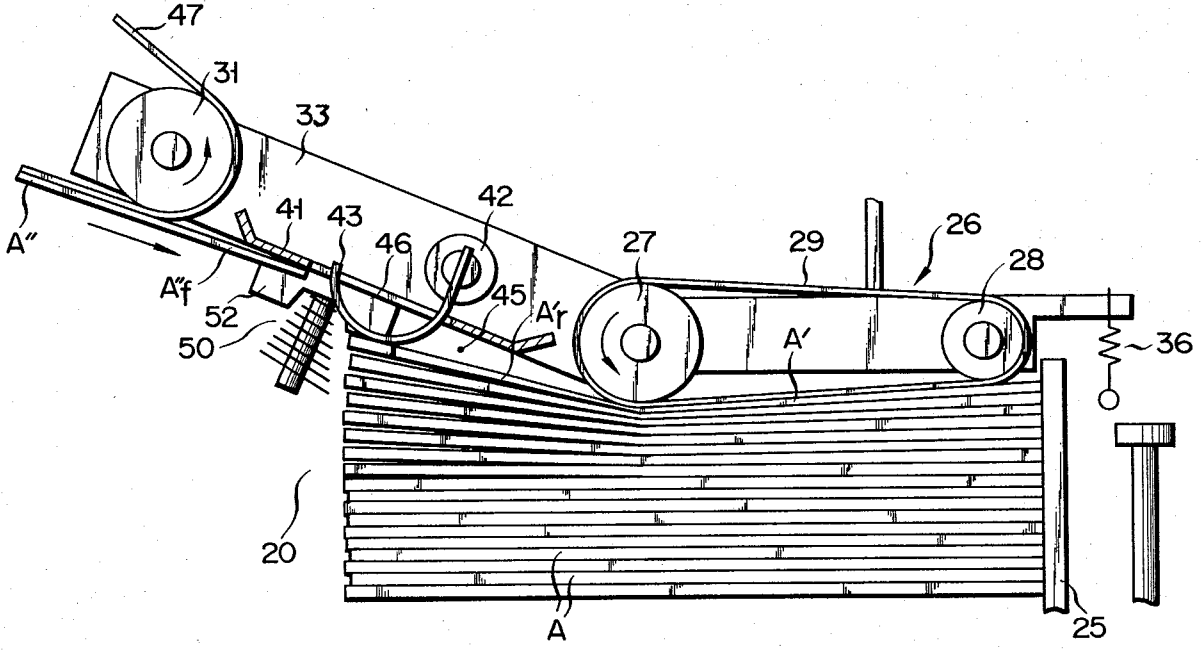
FIGS. 4, 5 and 6 are fragmentary enlarged-scale top views for explaining the operation of an essential part shown in FIG. 2.

As shown in FIG. 4, articles are supplied one by one from the conveyor mechanism 30 into the article supply path 45 in the direction of the arrow. By this time, the article urging member 43 has been brought to the advanced position. That is, the lever 43 is engaging the rear end portion Ar' of the outermost article A' in the stack of articles A and serving to prevent the outermost article's rear end portion Ar from blocking the article supply path 45. If the action of the lever 43 is absent, the rear end portion of a very flexible article which is not urged by the belt 29 would be bent to block the path 45.

Figure 5:
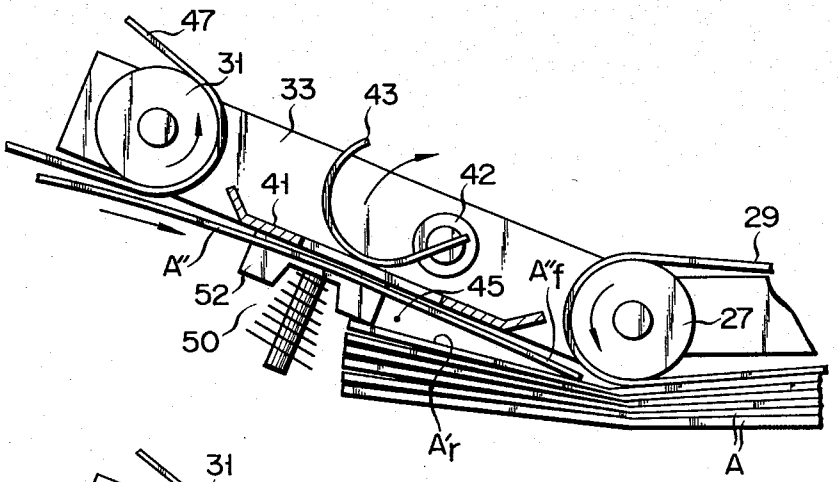

When the forward end Af'' of an article A'' introduced into the path 45 is about to touch the lever 43, the lever 43 is rocked by the action of the rotary solenoid 42 to the retreated position, thus allowing the article A' to be supplied between the guide plate 41 and the outermost article in the stack of articles A, as shown in FIG. 5. As soon as the article urging lever 43 is retreated, the rear end portion Ar' of the outermost article that has been held urged by the level 43 is allowed to enter into the path 45 with its own elasticity. However, this movement is slow enough to let the forward end Af'' of the article A'' to proceed toward the stacking section and enter the gap between the endless belt 29 and outermost article A' as shown in FIG. 5.

Figure 6:
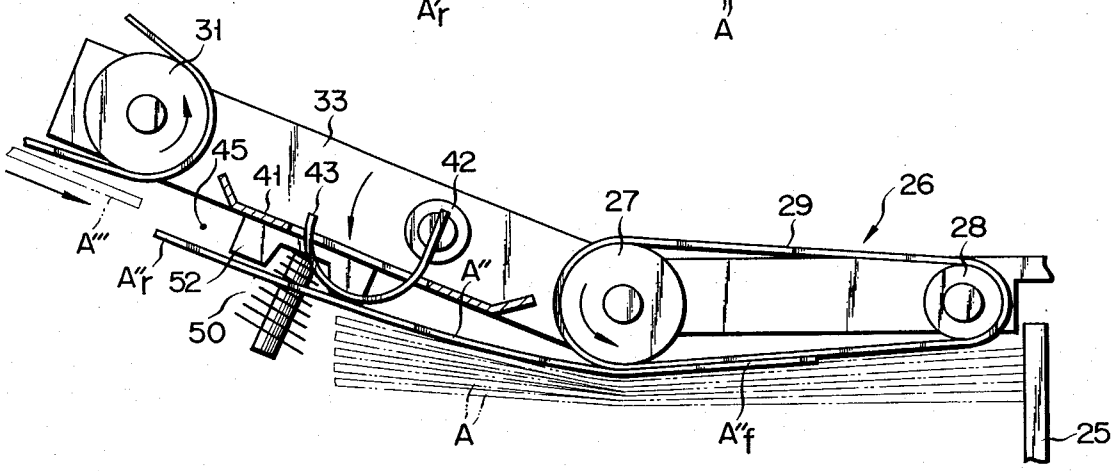

As the forward end portion Af'' of the article is being forcibly fed into the stacking section, the lever 43 is brought to the advanced position again as shown in FIG. 6 to urge the rear end portion Ar'' of the article A'' crosswise with respect to the longitudinal direction of the path 45. The lever 43 desirably urges an upper half of the upright article A'' as shown in FIG. 3.

This has an effect of causing deviation of the lower edge of the article A'' in the crosswise direction so that it gets out of the cover plate 52 to be brought onto the rotating feed screw member 50. As the lower edge of the article slides slightly over the feed screw member 50, it is eventually engaged in the thread of the feed screw member 50. As a result, the lower edge of the article A'' is positively displaced away from the article supply path 45. With this crosswise displacement of the rear end portion Ar'' of the article A'', the inlet of the article supply path 45 can be reliably made wider. Thus, the next article A''' can suceedingly enter the path 45 without the possibility of jamming as shown by imaginary lines in FIG. 6.

As has been shown, in each supply cycle the article urging lever 43 is brought to the retracted position when an article enteres the path 45, then moved back to the advanced position in a short time and held in the advanced position for the rest of the cycle.

If articles longer than those shown in FIG. 4 are piled in a stack, the rear portion of the outermost article reaches the feed screw member 50. The rear portion of the outermost article then abuts on the large-diameter end of the feed screw member 50 and can not enter the article supply path 45. The screw member 50 cooperates with the urging lever 43 to positively hold the rear portion of the article outside the path 45.

As the number of stacked articles is increased, the stacking pressure is also increased. Also, with increase of the number of stacked articles the endless belt 29 is moved outward against the biasing force of the spring 36, that is, the support lever 33 is rocked in the direction of the arrow in FIG. 2. Eventually, the microswitch 40 is turned on by the arm 37. As a result, the motor 62 (FIG. 8) is operated to move the belt member 22 together with the back-up member 12 in the direction of the arrow in FIG. 2, thus reducing the stacking pressure exerted to the stacked articles A. At the same time, the endless belt 29 is restored to the initial position by the force of the spring 36. When the microswitch 40 is turned off subsequently, the motor 62 is stopped. Thus, the initial state is recovered.

As has been shown, as soon as the stacking pressure reaches a limit value, the back-up plate 21 is automatically fed to reduce the stacking pressure so that the stacking pressure can always be held in a desired range. Thus, articles can always be supplied into the stacking section 20 smoothly and efficiently.

What is claimed is:

1. An apparatus for stacking letter mail side by side in the upright state in a stacking position in a stacking section, said apparatus comprising:

a letter mail supply path extending toward said stacking section through which the letter mail is supplied;

letter mail supply means for supplying pieces of letter mail one by one in the upright state through said letter mail supply path;

letter mail supporting means provided with a surface for supporting the bottom of the letter mail stacked in said stacking section on the surface;

holding means connected to said letter mail supply path for holding the stacked letter mail, and including a forcible feeding means for engaging the forward end portion of each piece of the letter mail supplied from said letter mail supply path and for forcibly feeding said piece to the stacking position, and urging means for urging a rear end portion of the piece of the letter mail; and a movable back-up means facing said holding means for co-operating with said holding means to sandwich the stacked letter mail between said holding means and movable back-up means, said urging means including a lever means which is pivotally supported on the holding means side of the supply path, and movable between an advanced position in which the free end of the lever is located in the stacking section and capable of pushing the rear end portion of the letter mail against the movable back-up means, and a retracted position in which said lever means is separated from the supply path such that the next piece of the letter mail can be supplied along the supply path, detecting means provided along the supply path at a location upstream of said lever means with respect to the feeding direction of the letter mail, said detecting means for detecting the forward end of the letter mail which has passed through the detecting means, and driving means for keeping the lever means in the advanced position when the detecting means does not detect the letter mail, and for moving the lever means from the advanced position to the retracted position during a given time until the forward end of the piece of the letter mail passes beyond the lever means when the detecting means detects the forward end portion of the piece of the letter mail.

2. The apparatus according to claim 1, wherein said forcible feed means includes a pair of spaced-apart rollers and an endless belt passed around said rollers, a portion of said endless belt constituting an effective urging surface.

3. The apparatus according to claim 1, wherein said apparatus further comprises: means for allowing the movement of said holding means for a slight distance caused by the urging action of the stacked articles; detecting means for detecting the point at which said holding means reaches a limit position of the range of movement; and means for moving said back-up means in a direction of reducing the urging force of the stacked articles applied to said holding means according to the operation of said detecting means.

4. The apparatus according to claim 1, wherein said lever means is a curved lever member driven by a rotary solenoid.

5. The apparatus according to claim 1, further comprising a guide plate defining part of one side wall of said article supply path.

6. The apparatus according to claim 5, wherein said guide plate further defines an opening and wherein said urging means is movable to said advanced position on said letter mail supply path through said opening defined in said guide plate.

7. The apparatus according to claim 2, wherein said letter mail supply path is inclined with respect to said effective urging path of said endless belt.

8. The apparatus according to claim 1, further comprising letter mail attitude regulating means extending substantially crosswise with respect to the longitudinal direction of said letter mail supply path and engageable with the lower edge of a piece of said letter mail supplied into said letter mail supply path for regulating the attitude of said letter mail.

9. The apparatus according to claim 8, wherein said letter mail attitude regulating means is a rotatable feed screw member, the lower edge of the letter mail being adapted to be engaged by said feed screw member and displaced thereby substantially crosswise with respect to the longitudinal direction of the article supply path.

10. The apparatus according to claim 8, further comprising a cover plate located in the vicinity of said letter mail attitude regulating means such as to prevent the action of said letter mail attitude regulating means on a piece of said letter mail while said letter mail piece is in said article supply path.

11. The apparatus according to claim 8, wherein said urging means is located to engage an upper half of a piece of letter mail supplied into said letter mail supply path.

12. The apparatus according to claim 1, wherein said back-up means is supported on said letter mail supporting surface in frictional contact therewith, and wherein said letter mail supporting surface moved together with said back-up means by driving means.

13. The apparatus according to claim 12, wherein said holding means is carried by a support lever pivotal about an axis and elastically urged toward the stacked letter mail by spring means, said support lever being adapted to be pivoted against the action of said spring means by the urging force of said stacked letter mail; detecting switch means for detecting said holding means reaching a limit position of the range of movement; and wherein said driving means is operated with the operation of said detecting switch means to move said letter mail supporting surface together with said back-up means in a direction of reducing the urging force of the stacked articles exerted to said holding means.

14. The apparatus according to claim 9, wherein the rotational driving of said feed screw member, driving of said letter mail supply means and driving of said forcible feed means are all effected simultaneously by a pulley-string transmission mechanism.

* * * * *